US007109405B2

(12) United States Patent
Brown

(10) Patent No.: US 7,109,405 B2
(45) Date of Patent: Sep. 19, 2006

(54) D TUNER

(76) Inventor: Dave Brown, 4560 Layhigh Rd., Hamilton, OH (US) 45013

( * ) Notice: Subject to any disclaimer, the term of this patent is extended or adjusted under 35 U.S.C. 154(b) by 190 days.

(21) Appl. No.: 10/929,499

(22) Filed: Aug. 31, 2004

(65) Prior Publication Data

US 2006/0042452 A1 Mar. 2, 2006

(51) Int. Cl.
*G10G 7/02* (2006.01)

(52) U.S. Cl. ..... 84/318; 84/455

(58) Field of Classification Search ..... 84/455, 84/297 R, 318, 315, 454, 456; 984/108, 984/110

See application file for complete search history.

(56) References Cited

U.S. PATENT DOCUMENTS

| | | | | |
|---|---|---|---|---|
| 1,531,458 | A | | 3/1925 | Staples |
| 1,660,267 | A | | 2/1928 | Hughes |
| 1,697,508 | A | | 1/1929 | Kordick |
| 2,746,337 | A | | 5/1956 | Smit |
| 2,961,913 | A | | 11/1960 | Popkin |
| 3,205,751 | A | | 9/1965 | Lowe |
| 3,230,816 | A | * | 1/1966 | Jira ..... 84/315 |
| 3,412,638 | A | * | 11/1968 | Pease ..... 84/455 |
| 3,680,427 | A | | 8/1972 | Valentino |
| 3,704,646 | A | | 12/1972 | Davis et al. |
| 3,818,793 | A | | 6/1974 | Round |
| 3,915,051 | A | | 10/1975 | Kincaid |
| 4,671,156 | A | * | 6/1987 | Hathcock ..... 84/318 |
| 5,081,894 | A | * | 1/1992 | Paige ..... 84/318 |
| 536,563 | A | | 3/1995 | Converse |
| 5,492,045 | A | * | 2/1996 | Roblee ..... 84/318 |
| 5,955,689 | A | * | 9/1999 | Feiten et al. ..... 84/312 R |
| 6,806,411 | B1 | * | 10/2004 | Allen ..... 84/454 |
| 6,965,067 | B1 | * | 11/2005 | Kondo ..... 84/455 |

* cited by examiner

*Primary Examiner*—Gary F. Paumen
(74) *Attorney, Agent, or Firm*—Greenblum & Bernstein, P.L.C.

(57) ABSTRACT

A tuner for a stringed instrument including a base unit, a pair of projections extending upwardly from the base unit, and a clamping bar for attachment to the base unit with a neck of the stringed instrument therebetween. The tuner also includes tuning screws for moving the projections linearly to change string tension, and a pair of externally threaded posts extending from a bottom surface of the base unit, and a pair of nuts to secure the tuner onto the stringed instrument.

13 Claims, 3 Drawing Sheets

D TUNER

BACKGROUND OF THE INVENTION

1. Field of the Invention

The present invention relates to a device that changes the key to which a stringed instrument is tuned, and more particularly, that changes the key to which a stringed instrument is tuned easily, quickly, and accurately.

2. Description of the Related Art

Tuning devices for stringed instruments are known in the prior art. A tuning device for a banjo is disclosed, for example, by U.S. Pat. No. 536,563 to CONVERSE. The CONVERSE tuning device includes an adjustable foot and a vibrator movable along a truss. To operate this tuning device, a tuned string is clamped between the adjustable foot and the finger board of the stringed instrument. The vibrator is then adjusted to rest against an adjacent string, and the peg of the adjacent string is turned until a singing tone indicates that the string is in tune. This process is then repeated for the other strings.

The prior art also includes a device for tuning the E string of a violin while playing the instrument, as disclosed in U.S. Pat. No. 1,531,458 to STAPLES; and a device for tuning steel strings of a violin, as disclosed in U.S. Pat. No. 1,660,267 to HUGHES. The prior art also includes a device for tuning a stringed instrument, such as a ukulele, as disclosed in U.S. Pat. No. 1,697,508 to KORDICK, in which all of the strings are simultaneously arranged and tuned, then subsequently released. The prior art also includes a tuning device especially for a nonfretted stringed instrument as disclosed in U.S. Pat. No. 2,961,913 to POPKIN.

The prior art includes a stringed musical instrument including a capo adjustable along the neck of the instrument, as disclosed for example in U.S. Pat. No. 3,205,751 to LOWE. Also known in the prior art are tuning devices disclosed for example, in U.S. Pat. No. 3,704,646 to DAVIS et al.; U.S. Pat. No. 3,680,427 to VALENTINO; and U.S. Pat. No. 3,818,793 to ROUND.

Further, a chord changing device is disclosed in U.S. Pat. No. 2,746,337 to SMIT, which discloses a device to enable an unskilled player to easily play chords. Further, U.S. Pat. No. 3,915,051 to KINCAID discloses a device for simplifying chord playing on a stringed instrument.

A disadvantage of the prior art is the lack of a device which enables easy, quick, and accurate tuning of a stringed instrument before playing and while playing the instrument. Another disadvantage of the prior art is the device which uses adjustable stops on the rotation of the instrument tuners. Such adjustable stops are difficult to set and require constant adjustment; and such units are particularly difficult to reset when replacing a string.

SUMMARY OF THE INVENTION

The present invention is directed to a tuner, which addresses the problems existing in the prior art, discussed above. The present invention provides a device which enables easy, quick, and accurate changing of the key to which a stringed instrument is tuned before playing and while playing the instrument. Additionally, the present invention provides a device which enables a stringed instrument to play slurred notes, i.e., notes that start at one pitch and increase or decrease to another pitch. Further, the present invention provides a device that can be easily, simply, and quickly clamped onto a stringed instrument without modifying the instrument. Further, the tuner of the present invention may be clamped onto a stringed instrument, and is easy to set up for use. Further, in the present invention, the direction of rotation of each knob for increasing or decreasing pitch is standardized and requires substantially the same amount of rotation of the knob for each string, despite the change in the string by one or two semitones.

Additionally, the locking action of the tuner of the present invention is independent of its being perpendicular to the string. Accordingly, the rotational position of the knob is the same for each installation. Further, the tuner of the present invention reduces the interaction of the adjustment of the high and low notes. The lower pitch setting which is adjusted with the present invention will generally remain correct as the higher pitch is tuned with the normal tuning pegs, requiring only slight trimming on occasion. This is true even when changing strings.

Further, with the tuner of the present invention, drilled holes are unneeded. Therefore, any loss in resale value of the instrument due to drilled holes is eliminated.

An aspect of the present invention provides a tuner for a stringed instrument, the tuner including a base unit including a top surface and a bottom surface; a pair of projections extending upwardly from the top surface of the base unit, the projections configured for engagement with strings of the stringed instrument; and a clamping bar configured for attachment to the bottom surface of the base unit with a neck of the stringed instrument there between. In a further aspect of the present invention, the tuner further includes at least one slot provided in the base unit; a pair of sliders configured for movement in the slot and including a means to convert rotary movement to linear movement thereon, each projection extending from one of the sliders; and a pair of drivers configured to actuate the conversion means, the conversion means driving the pair of sliders with the projections extending therefrom linearly. Further, each driver may include a tuning screw provided in a threaded hole in the base unit.

In a further aspect of the present invention, the projections are configured for engagement with a string on a side of the projection. Further, the projections are moveable toward and away from each other to change tension in the strings of the stringed instrument. The tuner may further include a pair of externally threaded posts extending from the bottom surface of the base unit; and a pair of nuts, wherein each externally threaded post is received in one of the nuts to secure the clamping bar onto the base unit and the tuner onto the stringed instrument. Further, the tuner may further include a pair of externally threaded posts extending from the bottom surface of the base unit; and a pair of nuts, wherein each externally threaded post is received in one of the nuts to secure the clamping bar onto the base unit and the tuner onto the stringed instrument. Further, each conversion means further includes an actuator shaft extending therefrom and each threaded post includes a hollow interior therein configured as a bearing for one of the actuator shafts.

In a further aspect of the present invention, each projection is configured for engagement with a string on a side of the projection, and the projections are moveable linearly to change between one tuning and another tuning of the stringed instrument. Further, each projection is configured for engagement with a string on a side of the projection, and the projections are moveable linearly while playing the stringed instrument to provide slurring of notes. Additionally, the tuner may further include a least one slot provided in the base unit; a pair of sliders configured for movement in the slot and including a rotary movement to linear movement converter, each projection projecting from one of the sliders; a pair of drivers configured to actuate the converter, the converter driving the pair of sliders with the projections extending therefrom linearly. The rotary movement to linear movement converter includes a cam surface provided on each of the sliders; and a pair of cams provided on the base unit, each cam configured to engage the cam surface of one of the sliders; and each of the cams further includes an actuator shaft extending therefrom and each threaded post includes a hollow interior therein configured as a bearing for one of the actuator shafts.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which.

DETAILED DESCRIPTION OF THE INVENTION

Figure 1:
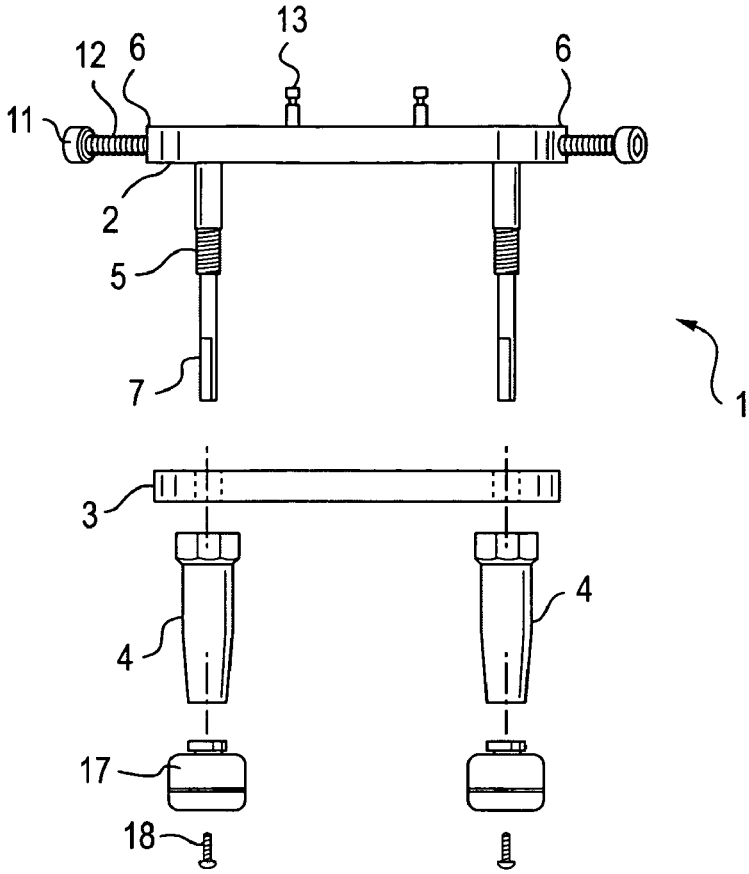
FIG. 1 is an exploded front elevational view of an embodiment of the tuner of the present invention.
Figure 2:
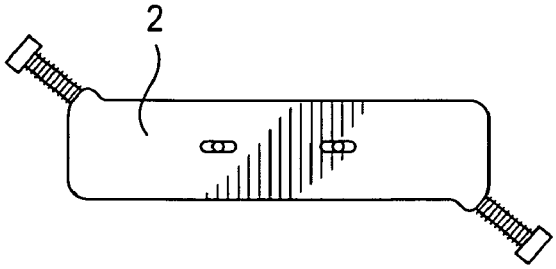
FIG. 2 is a top view of the base unit of the tuner of the embodiment of FIG. 1.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The present invention is directed to a tuner for a stringed instrument such as, for example, a banjo or a guitar. The tuner of the present invention changes the key to which an instrument is tuned. With reference to FIGS. 1–6 of the drawings, reference numeral 1 denotes the tuner of the present invention. The tuner 1 includes a base unit 2, a clamping bar 3, and a pair of elongated nuts 4. When the tuner is installed, the neck of a stringed instrument is clamped between the base unit 2 and the clamping bar 3. The clamping bar 3 is tightened onto the base unit 2 by the elongated nuts 4.

Figure 3:
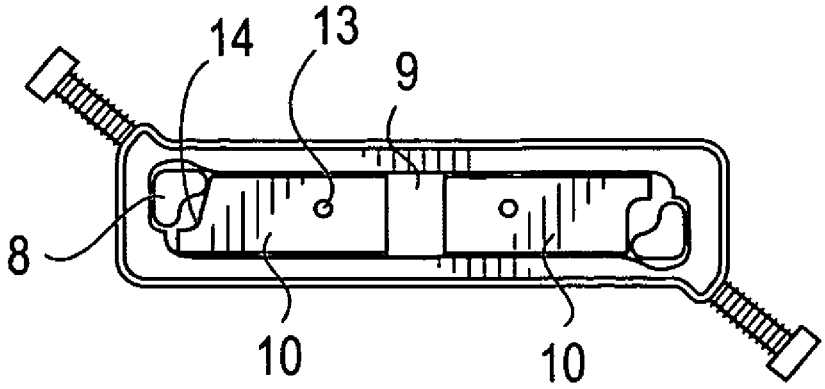
FIG. 3 is a top view of the base unit of the tuner of the embodiment of FIG. 1 with the cover plate removed and showing the sliders in a first position.
Figure 4:
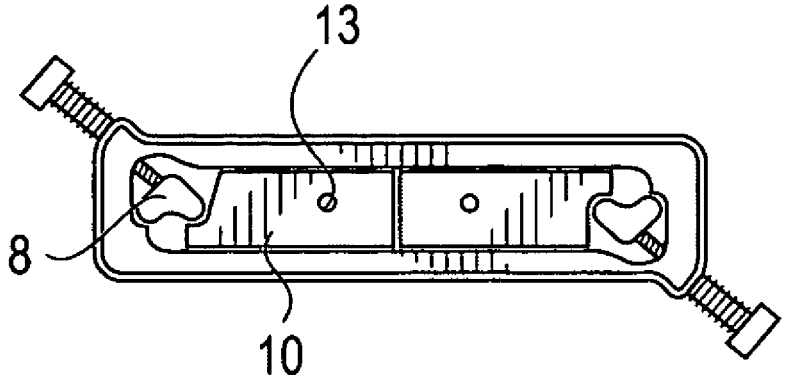
FIG. 4 is a top view of the base unit of the tuner of the embodiment of FIG. 1 with the cover plate removed and showing the sliders in a second position.
Figure 5:
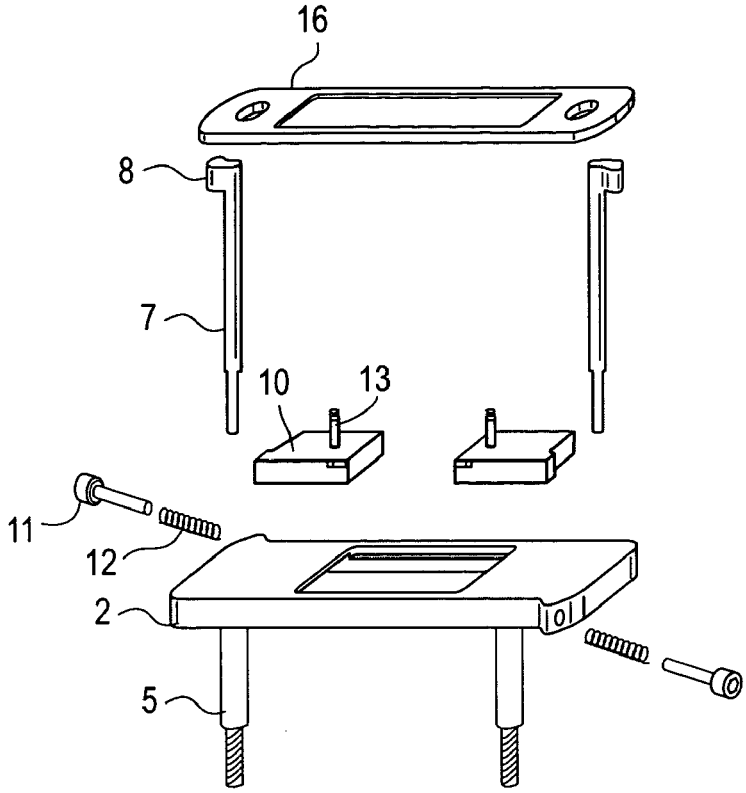
FIG. 5 is an exploded perspective view of the base unit of the tuner of the embodiment of FIG. 1.
Figure 6:
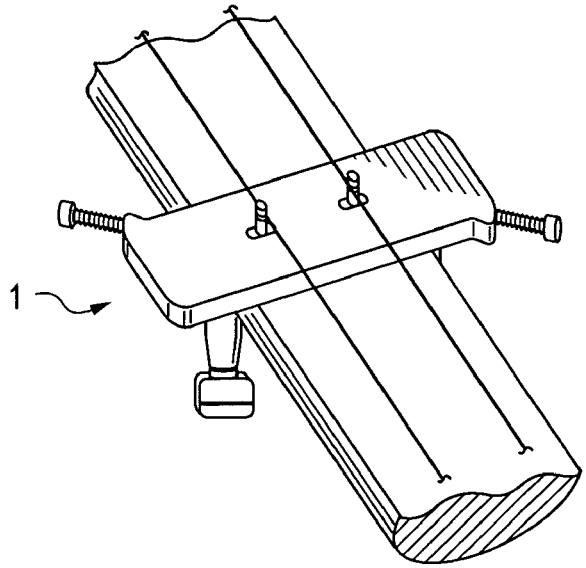
FIG. 6 is a perspective view of the tuner of the embodiment of FIG. 1, showing the tuner mounted on the neck of a stringed instrument.

As shown in FIGS. 1–6, the base unit 2 has a substantially elongated rectangular shape and includes a pair of hollow externally threaded posts 5 extending from the bottom of the base unit 2 at opposite ends thereof. The threaded posts 5 are received in the nuts 4, and the nuts 4 are tightened to clamp the base unit 2 onto the instrument. Additionally, the hollow interior of each threaded post 5 serves as a bearing for an actuator shaft 7. As shown in FIGS. 4 and 5, the base unit 2 also includes slots 9 in which the sliders 10 move. The tuner includes a device that converts rotary motion to linear motion, and in the present embodiment, each slider 10 includes a shaped cam surface 14, along which a cam 8 rides for moving the slider 10 along the slot 9. Each cam 8 includes an actuator shaft 7 extending therefrom which is received in the hollow bearing interior of a threaded post 5. The actuator shafts 7 include opposing flat surfaces for receiving the knobs 17. A knob 17 is mounted onto the exposed end of each actuator shaft 7. Small screws 18 may be provided to secure the knobs onto the actuator shafts 7. The screws 18 provide the ability to increase and decrease the turning friction of the actuator shafts 7, according to the user's preference. Further, each slider 10 includes a vertical projection 13 extending from the top thereof for engagement with a string of the instrument. The vertical projections 13 engage and bend a string of the instrument, changing the tension in the string and thereby changing the tuned pitch of the string. The base unit 2 also includes a pair of threaded through holes 6 extending through opposite ends thereof. Each threaded through hole 6 receives a tuning screw 11 having thereon a device to hold the position of the tuning screw 11 such as, for example, a spring 12. The base unit 2 further includes a cover plate 16 to finish the unit and protect the projection moving mechanisms.

Accordingly, the tuning mechanism starts in a first position in which the tuning screws 11 and sliders 10 are in the outermost positions, as shown in FIG. 3. During operation, the cams are turned with the knobs to move outwardly away from the center of the base unit 2, the end of the tuning screw 11 impinges the rear surface of the cam 8, acting as a stop which establishes the lower pitch.

The tuner 1 of the present invention may be formed of any suitable material such as, for example, machined metal, cast metal, or plastic. Further, the knobs may be formed of any suitable material such as, for example, metal or plastic.

To attach the tuner 1 to a stringed instrument, the tuner 1 is clamped onto the headstock of the instrument with the clamping bar 3 by tightening the nuts 4. The base unit 2 is positioned underneath the strings with the projections 13 extending outward therefrom and so that the strings are positioned inside or between the projections 13. When the cams 8 hold a string in a higher tension (higher pitch) position, the standard tuners (i.e., the pegs) for the instrument are used to tune that string to the desired pitch. When the tuning screw 11 is turned, individually for each string, the projection 13 is moved linearly along the base unit 2, thus reducing the tension and the pitch of the string. This tension (and pitch) is adjusted with the tuning screws 11, which limit the movement of the sliders 10 and the actuator shafts 7. In use, on a banjo, for example, the tuner 1 of the present invention allows the rapid changing between tuning types. For example, the tuner 1 of the present invention provides rapid changing between standard G tuning and D tuning for the strings on which is used. The tuner 1 of the present invention also allows the "slurring" of notes, giving a special effect to the music.

Alternatively, the actuator mechanism 7 may include elements such as, for example, rollers to reduce friction, or a series of levers or gears to convert the rotary motion of the actuator shaft 7 into the linear motion of the sliders.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

What is claimed is:

1. A tuner for a stringed instrument, said tuner comprising:

a base unit including a top surface and a bottom surface;

a pair of projections extending upwardly from said top surface of said base unit, said projections configured for engagement with strings of the stringed instrument; and a clamping bar configured for attachment to said bottom surface of said base unit with a neck of the stringed instrument there between.

2. The tuner for a stringed instrument according to claim 1, further comprising:

at least one slot provided in said base unit;

a pair of sliders configured for movement in said slot and including a means to convert rotary movement to linear movement thereon, each said projection extending from one of said sliders; and a pair of drivers configured to actuate said conversion means, said conversion means driving said pair of sliders with said projections extending therefrom linearly.

3. The tuner for a stringed instrument according to claim 2, wherein each said driver comprises a tuning screw provided in a threaded hole in said base unit.

4. The tuner for a stringed instrument according to claim 1, wherein each said projection is configured for engagement with a string on a side of said projection.

5. The tuner for a stringed instrument according to claim 1, wherein said projections are moveable toward and away from each other to change tension in the strings of the stringed instrument.

6. The tuner for a stringed instrument according to claim 1, further comprising:

a pair of externally threaded posts extending from said bottom surface of said base unit; and a pair of nuts, wherein each said externally threaded post is received in one of said nuts to secure said clamping bar onto said base unit and said tuner onto the stringed instrument.

7. The tuner for a stringed instrument according to claim 2, further comprising:

a pair of externally threaded posts extending from said bottom surface of said base unit; and a pair of nuts, wherein each said externally threaded post is received in one of said nuts to secure said clamping bar onto said base unit and said tuner onto the stringed instrument.

8. The tuner for a stringed instrument according to claim 7, wherein each of said conversion means further comprises an actuator shaft extending therefrom and each said threaded post includes a hollow interior therein configured as a bearing for one of said actuator shafts.

9. The tuner for a stringed instrument according to claim 1, wherein each said projection is configured for engagement with a string on a side of said projection, and said projections are moveable linearly to change between one tuning and another tuning of the stringed instrument.

10. The tuner for a stringed instrument according to claim 1, wherein each said projection is configured for engagement with a string on a side of said projection, and said projections are moveable linearly while playing the stringed instrument to provide slurring of notes.

11. The tuner for a stringed instrument according to claim 1, further comprising:

a least one slot provided in said base unit;

a pair of sliders configured for movement in said slot and including a rotary movement to linear movement converter, each said projection projecting from one of said sliders;

a pair of drivers configured to actuate said converter, said converter driving said pair of sliders with said projections extending therefrom linearly.

12. The tuner for a stringed instrument according to claim 11, wherein said rotary movement to linear movement converter comprises:

a cam surface provided on each of said sliders; and a pair of cams provided on said base unit, each cam configured to engage said cam surface of one of said sliders.

13. The tuner for a stringed instrument according to claim 12, wherein each of said cams further comprises an actuator shaft extending therefrom and each said threaded post includes a hollow interior therein configured as a bearing for one of said actuator shafts.

* * * * *